US007262366B2

(12) United States Patent
Clark

(10) Patent No.: US 7,262,366 B2
(45) **Date of Patent: *Aug. 28, 2007**

(54) BUNDLED CABLE USING VARYING TWIST SCHEMES BETWEEN SUB-CABLES

(75) Inventor: William T. Clark, Lancaster, MA (US)

(73) Assignee: Belden Technologies, Inc., St. Louis, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/399,882

(22) Filed: Apr. 7, 2006

(65) Prior Publication Data

US 2006/0175077 A1 Aug. 10, 2006

Related U.S. Application Data

(63) Continuation of application No. 11/051,487, filed on Feb. 4, 2005, now Pat. No. 7,053,310.

(60) Provisional application No. 60/542,516, filed on Feb. 6, 2004.

(51) Int. Cl.
*H01B 11/00* (2006.01)

(52) U.S. Cl. ..... 174/113 R

(58) Field of Classification Search ..... 174/113 R, 174/113 C, 131 A, 36

See application file for complete search history.

(56) References Cited

U.S. PATENT DOCUMENTS 1,854,795 A 4/1932 Kaempf
4,408,443 A 10/1983 Brown et al.
4,446,689 A 5/1984 Hardin et al.
5,043,530 A 8/1991 Davies
5,155,789 A 10/1992 Le Noane et al.
5,202,946 A 4/1993 Hardin et al.
5,298,680 A 3/1994 Kenny
5,418,878 A 5/1995 Sass et al.
5,574,250 A 11/1996 Hardie et al.
5,659,152 A 8/1997 Horie et al.
6,248,954 B1 6/2001 Clark et al.
6,300,573 B1 10/2001 Horie et al.
6,355,876 B1 3/2002 Morimoto
6,462,268 B1 10/2002 Hazy et al.

(Continued)

FOREIGN PATENT DOCUMENTS

WO WO 2005/041219 A1 5/2005

*Primary Examiner*—Chau N. Nguyen
(74) *Attorney, Agent, or Firm*—Lowrie, Lando & Anastasi, LLP

(57) ABSTRACT

Bundled cables including a plurality of sub-cables, each sub-cable comprising a plurality of twisted pairs of insulated conductors. In one example, a bundled cable includes first and second sub-cables, each comprising a plurality of twisted pairs of insulated conductors that each has a unique twist lay. The first sub-cable may have a first lay scheme, the second sub-cable may have a second lay scheme that is different than the first lay scheme at any point along a longitudinal axis of the bundled cable. The first, and second sub-cables are bundled together, for example, with a jacket, shield or binder, and a delta in twist lay between a closing lay of any one twisted pair of the first plurality of twisted pairs and a closing lay of any one twisted pair of the second plurality of twisted pairs is at least approximately 0.020 inches.

20 Claims, 3 Drawing Sheets

U.S. PATENT DOCUMENTS 6,639,152 B2 10/2003 Glew et al.
6,770,819 B2 8/2004 Patel
7,053,310 B2 * 5/2006 Clark ..... 174/113 R
2005/0087361 A1 4/2005 Hayes et al.
2006/0059883 A1 3/2006 Hopkinson et al.

* cited by examiner

BUNDLED CABLE USING VARYING TWIST SCHEMES BETWEEN SUB-CABLES

CROSS-REFERENCE TO RELATED APPLICATIONS

This application is a continuation of and claims priority under 35 U.S.C. §120 to U.S. patent application Ser. No. 11/051,487, filed Feb. 4, 2005 now U.S. Pat. No. 7,053,310 and entitled "Bundled Cable Using Varying Twist Schemes Between Sub-Cables," which in turn claims priority under 35 U.S.C. §119(e) to U.S. Provisional Application No. 60/542,516 entitled "Bundled Cable Using Varying Twist Schemes Between Sub-Cables," filed Feb. 6, 2004, both of which are herein incorporated by reference in their entireties.

BACKGROUND OF THE INVENTION

1. Field of Invention

The present invention relates to high-speed data communications cables using at least two twisted pairs of wires. More particularly, it relates to bundled cables including a plurality of individual cables bundled together.

2. Discussion of Related Art

High-speed data communications media often include pairs of wire twisted together to form a balanced transmission line. Such pairs of wire are referred to as twisted pairs. One common type of conventional cable for high-speed data communications includes multiple twisted pairs that may be twisted and bundled (cabled) together to form the cable. In addition, several individual cables are often twisted and bundled together to provide a bundled cable to facilitate installation. Two common types of cable that are often used in communications applications are unshielded twisted pair (UTP) cable and shielded twisted pair (STP) cable.

Communication cables must meet electrical performance characteristics required for transmission at high frequencies. The Telecommunications Industry Association and the Electronics Industry Association (TIA/EIA) have developed standards which specify specific categories of performance for cable impedance, attenuation, skew and crosstalk isolation. When twisted pairs are closely placed, such as in a cable, electrical energy may be transferred from one pair of a cable to another. Such energy transferred between pairs is referred to as crosstalk and is generally undesirable. The TIA/EIA have defined standards for crosstalk, including TIA/EIA-568A. The International Electrotechnical Commission (IEC) has also defined standards for data communication cable crosstalk, including ISO/IEC 11801. One high-performance standard for 100Ω cable is ISO/IEC 11801, Category 5, another is ISO/IEC 11801 Category 6.

In conventional cable, each twisted pair of a cable has a specified distance between common points of a twist along the longitudinal direction, that distance being referred to as the pair lay. When adjacent twisted pairs have the same pair lay and/or twist direction, they tend to lie within a cable more closely spaced than when they have different pair lays and/or twist direction. Such close spacing may increase the amount of undesirable crosstalk which occurs between adjacent pairs. Therefore, in some conventional cables, each twisted pair within the cable may have a unique pair lay in order to increase the spacing between pairs and thereby to reduce the crosstalk between twisted pairs of a cable. Twist direction may also be varied.

When two or more individual cables are bundled together to form a bundled cable, each individual cable, and the overall bundled cable, must meet the performance and, if plenum-rated, plenum standards discussed above. In order to save costs and simplify manufacturing of the bundled cable, a simple scheme to facilitate meeting the above requirements is desirable.

SUMMARY OF INVENTION

According to one embodiment, a bundled cable comprises a first sub-cable comprising a first plurality of twisted pairs of insulated conductors each having a unique twist lay, the first sub-cable having a first lay scheme, and a second sub-cable comprising a second plurality of twisted pairs of insulated conductors each having a unique twist lay, the second sub-cable having a second lay scheme that is different than the first lay scheme. The first and second sub-cables are bundled together, and a twist delta between a closing lay of any one twisted pair of the first plurality of twisted pairs and a closing lay of any one twisted pair of the second plurality of twisted pairs is at least approximately 0.020 inches. In one example, each sub-cable includes a jacket surrounding the twisted pairs of conductors. In another example, each sub-cable may include a conductive shield surrounding the twisted pairs. In yet another example, the bundled cable may include an overall shield or jacket at least partially enclosing the first and second sub-cables.

According to one example, the bundled cable may further comprise a third sub-cable comprising a third plurality of twisted pairs of insulated conductors each having a unique twist lay, the third sub-cable having a third lay scheme that is different than the first and second lay schemes.

According to another embodiment, a method of reducing crosstalk between twisted pairs of adjacent sub-cables in a bundled cable may comprise providing a first sub-cable comprising a first plurality of twisted pairs of insulated conductors each having a unique twist lay, the first sub-cable having a first lay scheme, providing a second sub-cable comprising a second plurality of twisted pairs of insulated conductors each having a unique twist lay, the second sub-cable having a second lay scheme that is different than the first lay scheme at any point along a longitudinal axis of the bundled cable, and bundling together the first and second sub-cables with an outer jacket that substantially encloses the first and second sub-cables along their lengths, and selecting the first lay scheme and the second lay scheme such that a delta in twist lay between a closing lay of any one twisted pair of the first plurality of twisted pairs of insulated conductors and a closing lay of any one twisted pair of the second plurality of twisted pairs of insulated conductors is at least approximately 0.020 inches. In another example, the delta may be in a range of approximately 0.020 inches to approximately 0.040 inches.

In one example, the step of bundling the first and second sub-cables together may includes bundling a filler together with the first and second sub-cables. In another example, the method may further comprises steps of providing a first conductive shield disposed about the first plurality of twisted pairs, and providing a second a conductive shield disposed about the second plurality of twisted pairs. In addition, the method may include providing an overall conductive shield at least partially surrounding the first and second sub-cables. In another example, the method may include providing a first jacket disposed about the first plurality of twisted pairs, and providing a second jacket disposed about the second plurality of twisted pairs. In addition, the method may further comprise a step of providing a jacket enclosing the first and second sub-cables.

According to another example, the method may further comprise steps of providing a third sub-cable comprising a third plurality of twisted pairs of insulated conductors each having a unique twist lay, the third sub-cable having a third lay scheme that is different than the first and second lay schemes, and selecting the third lay scheme such that the delta in twist lay between the closing lay of any one twisted pair of the first plurality of twisted pairs of insulated conductors and a closing lay of any one twisted pair of the second and third pluralities of twisted pairs of insulated conductors is at least approximately 0.020 inches.

BRIEF DESCRIPTION OF DRAWINGS

In the drawings, which are not intended to be drawn to scale, each identical or nearly identical component that is illustrated in various figures is represented by a like numeral. For purposes of clarity, not every component may be labeled in every drawing. The drawings are provided for the purposes of illustration and explanation and are not intended as a definition of the limits of the invention. In the drawings.

DETAILED DESCRIPTION

Figure 1:
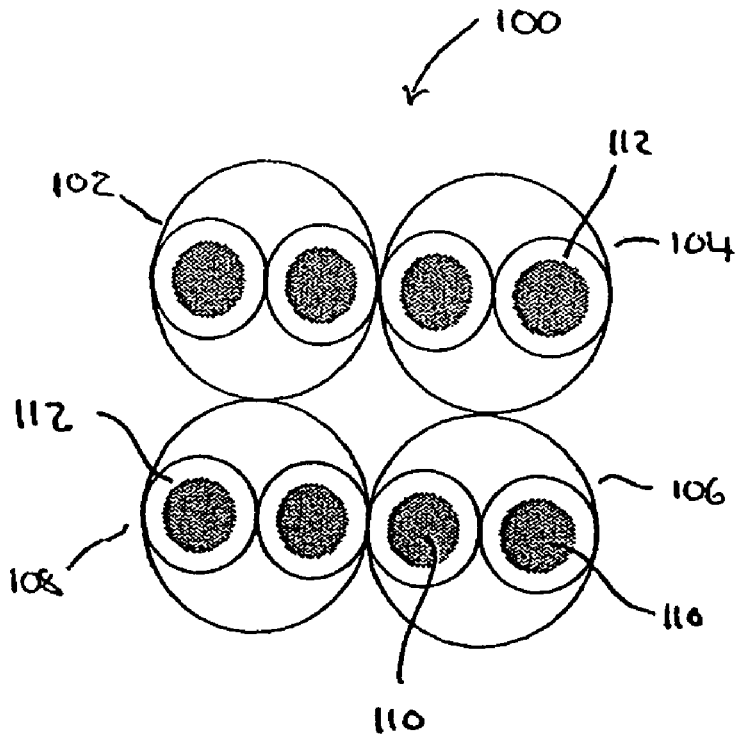
FIG. 1 is a diagram of a portion of a sub-cable including four twisted pairs, according to one embodiment of the invention.

Various illustrative embodiments and aspects thereof will now be described in detail with reference to the accompanying figures. It is to be appreciated that this invention is not limited in its application to the details of construction and the arrangement of components set forth in the following description or illustrated in the drawings. The invention is capable of other embodiments and of being practiced or of being carried out in various ways. Also, the phraseology and terminology used herein is for the purpose of description and should not be regarded as limiting. The use of "including," "comprising," or "having," "containing", "involving", and variations thereof herein, is meant to encompass the items listed thereafter and equivalents thereof as well as additional items. In addition, the term "sub-cable" as used herein refers to a single cable comprising a plurality of transmission media (e.g., twisted pairs) that may form part of a bundled cable. The term "bundled cable" refers to a cable comprising two or more sub-cables that are jacketed by an overall jacket layer so as to maintain the sub-cables in an approximate relation with one another.

Although the following description will refer primarily to a sub-cable that is constructed to include four twisted pairs of insulated conductors, it is to be appreciated that the sub-cables of the invention are not limited to the number of pairs used in this embodiment. The inventive principles can be applied to sub-cables including greater or fewer numbers of twisted pairs and optionally also including a pair separator that may be disposed between two or more of the twisted pairs of conductors. Also, although this embodiment of the invention is described and illustrated in connection with twisted pair data communication media, other high-speed data communication media can be used in the sub-cables according to the invention.

Referring to FIG. 1, there is illustrated one embodiment of portions of a sub-cable 100 including four twisted pairs 102, 104, 106 and 108. Each twisted pair is twisted with an individual twist lay. In addition, the plurality of twisted pairs in the sub-cable may be, in turn, twisted together about a longitudinal axis of the cable with a cable lay. This "cable lay" may help prevent variation in the twist lay, pair-to-pair distances, and other undesirable variation in the lay configuration of a cable that may result from bending, cornering, or otherwise mechanically disturbing the cable. When a cable lay is twisted in the same direction as a given pair twist lay (e.g., clockwise twist lay and clockwise cable lay), the cable lay tends to "tighten" the twisted pair's lay length, that is, it shortens the twist lay length of a twisted pair. When a cable lay is twisted in the opposite direction of a given pair twist lay (e.g., a clockwise twist lay and a counter-clockwise cable lay), the cable tends to "loosen" the twisted pair, that is, it lengthens twist lay length of the twisted pair. Therefore, the cable lay may effect the twist lay of each twisted pair either by increasing or decreasing the twist lay lengths of each twisted pair in the sub-cable. This final pair twist lay of each twisted pair (after cabling) is referred to herein as the "closing lay."

As shown in FIG. 1, each twisted pair 102, 104, 106, 108 includes two conductors 110, each insulated by an insulation layer 112. The conductors 110 may be metal, such as, for example, copper, and may be other conductors used in the industry. The insulation layers 112 may be any suitable insulation material used in the industry, such as, but not limited to, polyethylene, a fluoropolymer, fluoroethylenepropylene (FEP), and other suitable insulation materials. In addition, the insulation layers 112 may be, for example, foamed or solid, and in some applications, for example, where the sub-cables are desired to be plenum-rated, may include flame retardant and/or smoke suppressive additives, as well as other insulation layers that are used in the industry.

As discussed above, when twisted pairs are closely placed, such as within sub-cable 100, electrical energy may be transferred from one twisted pair to another, causing cross-talk between the twisted pairs and particularly between adjacent twisted pairs. In order to provide crosstalk isolation between the twisted pairs, the twist lays of each of the twisted pairs may be varied, such that there is a certain minimum "twist delta," between adjacent twisted pairs. For example, twisted pair 102 may have a twist lay of 0.350 inches and twisted pair 104 may have a twist lay of 0.630 inches, resulting in a difference between the two twist lays, or a twist delta, of 0.280 inches.

According to one embodiment, each sub-cable within a bundled cable may be constructed to have a certain pair lay scheme that includes the twist lays of each twisted pair within the sub-cable, a cable lay of the sub-cable, and an arrangement of the twisted pairs within the sub-cable. The sub-cables making up a bundled cable may have at least three separate, different individual lay scheme groups.

Figure 2:
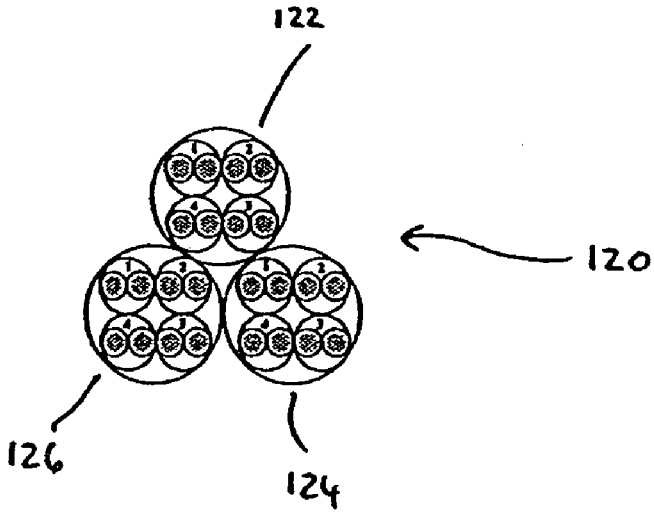
FIG. 2 is a diagram of one embodiment of a bundled cable, according to the invention.

Referring to FIG. 2, there is illustrated one example of a bundled cable 120 according to one embodiment of the invention, the bundled cable 120 comprising three sub-cables 122, 124, 126. Each sub-cable 122, 124, 126 may be provided with an individual lay scheme. For example, sub-cable 122 may have a lay scheme "A," sub-cable 124 a lay scheme "B" and sub-cable 126 a lay scheme "C." In one example, the sub-cables may be constructed such that there is a twist delta of at least 0.020 inches between the closing lay of any twisted pair within one sub-cable and the closing lay of any twisted pair in an adjacent sub-cable. Table 1 below provides one example of closing lays for each twisted pair of three sub-cables making up a bundled cable, as shown for example, in FIG. 2.

TABLE 1

| Sub-cable 1 | | Sub-cable 2 | | Sub-cable 3 | |
|---|---|---|---|---|---|
| Pair Number | Twist Lay (inches) | Pair Number | Twist Lay (inches) | Pair Number | Twist Lay (inches) |
| 102 | 0.350 | 102 | 0.330 | 102 | 0.430 |
| 104 | 0.630 | 104 | 0.590 | 104 | 0.700 |
| 106 | 0.380 | 106 | 0.410 | 106 | 0.550 |
| 108 | 0.770 | 108 | 0.670 | 108 | 0.880 |

It is to be appreciated that the twist lays given in Table 1 are examples of one embodiment, and many variations may be apparent to those of skill in the art. The given example is therefore not intended to be limiting, but rather is provided as an exemplary embodiment.

Figure 3:
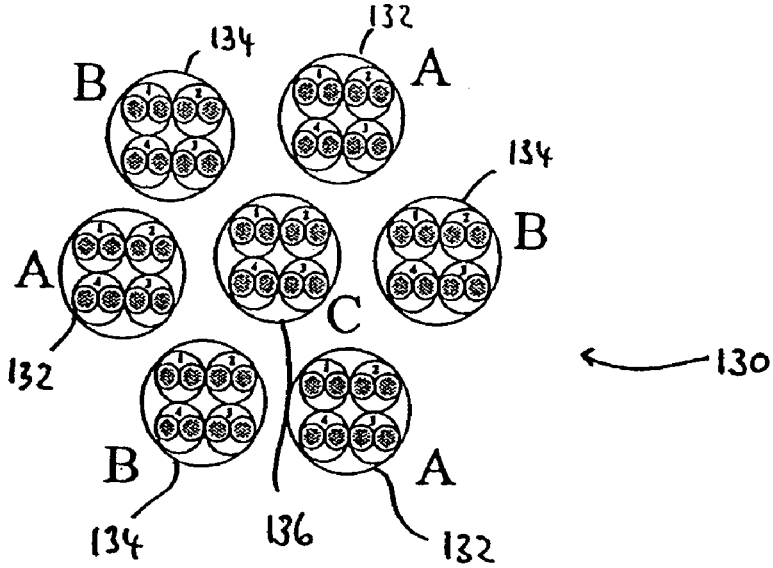
FIG. 3 is a diagram of another embodiment of a bundled cable, according to the invention.

According to another embodiment, illustrated in FIG. 3, a bundled cable 130 may comprise a plurality of sub-cables 132, 134 arranged around a center sub-cable 136. The plurality of sub-cables 132, 134 may be designated into groups according to their lay schemes, for example, sub-cables 132 may have lay scheme "A" and sub-cables 134 may have lay scheme "B," as illustrated. The central sub-cable 136 may have lay scheme "C." Thus, the central sub-cable 136 which is adjacent to each of the sub-cables 132, 134 may have a lay scheme that is different than each of the sub-cables 132, 134. In one example, the lay schemes A, B and C may be selected such that a minimum closing lay twist delta between any two twisted pairs of adjacent sub-cables (i.e., one twisted pair of sub-cable 132 and one twisted pair of an adjacent sub-cable 134) is at least 0.020 inches. For example, the lay schemes may be selected such that the closing lay of the twisted pairs of each of the sub-cables are those given in Table 1. However, it is to be appreciated that there are many alternative lay schemes, as will apparent to those of skill in the art. In another example, the closing lay twist delta between any two twisted pairs of adjacent sub-cables may be in a range of approximately 0.020 inches to 0.040 inches. It is to be appreciated that although in some embodiment the range of about 0.020 inches to 0.04 inches may be preferable, the invention is not so limited and the range may extend beyond about 0.04 inches. As illustrated in FIG. 3, the sub-cables 132, 134 may be arranged about the central sub-cable 136 in an alternating manner such that every sub-cable is adjacent sub-cables with different lay schemes. In this manner, a bundled cable comprising a plurality of sub-cables may be provided, wherein only three individual lay schemes may be used to maintain a desired level of cross-talk isolation between adjacent sub-cables.

Figure 4:
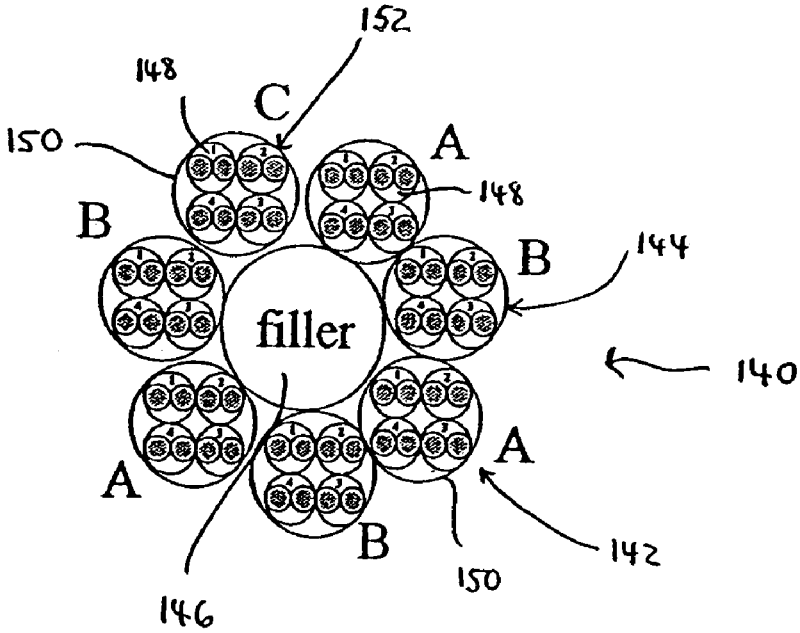
FIG. 4 is a diagram of another embodiment of a bundled cable, according to the invention.

Referring to FIG. 4, there is illustrated another embodiment of a bundled cable according to aspects of the invention. In the illustrated example, the bundled cable 140 may comprise a plurality of sub-cables 142, 144 arranged about a central filler 146. The sub-cables 142 may be constructed with a first lay scheme, for example, lay scheme "A" and the sub-cables 144 may be constructed with a second lay scheme, for example, lay scheme "B," as illustrated, and may be arranged about the central filler 146 in an alternating manner such that each sub-cable is adjacent two sub-cables with lay schemes different from its own lay scheme. Depending on the size of the filler 146, a sub-cable 152 with a third lay scheme, for example, lay scheme "C" may be provided so as to prevent two sub-cables with the same lay scheme from being adjacent one another. For example, as shown in FIG. 4, the size of the filler 146 may be such that if either a sub-cable 142 having lay scheme B or a sub-cable 144 having lay scheme A were placed in the location occupied by sub-cable 152, the result would be adjacent sub-cables having the same lay scheme. Therefore, sub-cable 152, having the different lay scheme "C" is provided to prevent this from occurring. The filler 146 may comprise a conductive or non-conductive material. For example, the filler may be a plastic or polymer material, a metal or other conductive or semiconductive material, or other materials known to those skilled in the art, or used in the industry.

It is to be appreciated that the lay scheme illustrated in FIG. 4 is one exemplary embodiment and other lay schemes between sub-cables may be used. For example, another lay scheme may be A-B-C, A-B-C, . . . , or A-B, A-B, A-B . . . , and many other lay schemes are possible.

Each of the sub-cables of any of the embodiments discussed above may be completed in any one of several ways. For example, referring to FIG. 4, the twisted pairs 148 may be optionally wrapped with a binder (not shown) and then jacketed with a jacket 150 to form a sub-cable 142. In one example, an overall conductive shield (not shown) can optionally be applied over the binder, or instead of the binder, before jacketing to prevent the sub-cable from causing or receiving electromagnetic interference. The jacket 150 may be, for example, PVC, or another suitable jacket material known to those of skill in the art. The binder may be, for example, a dielectric tape which may be polyester, or another compound generally compatible with data communications cable applications, including any applicable fire safety standards. It is to be appreciated that the sub-cables can be completed without either or both of the binder and the conductive shield, for example, by providing only the jacket 150, as shown. In addition, the bundled cable may be finished with a jacket and optionally a shield and/or binder as well.

Figure 5:
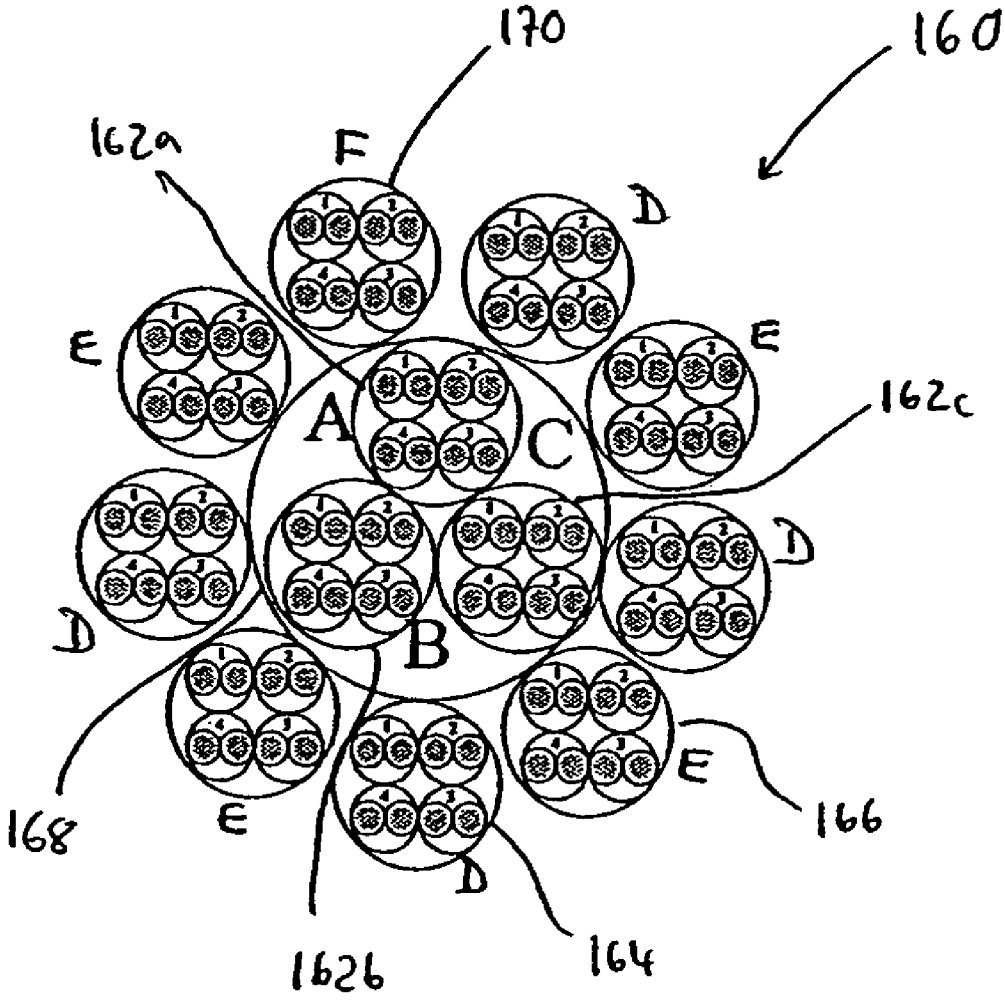
FIG. 5 is a diagram of yet another embodiment of a bundled cable, according to the invention.

According to another embodiment, illustrated in FIG. 5, a bundled cable 160 may comprise several sub-cables arranged in one or more groups or layers. For example, as shown in FIG. 5, an inner group having lay schemes A, B, C may be surrounded by an outer group or layer comprising a plurality of sub-cables 164, 166, having lay schemes D and E. However, it is to be appreciated that the invention is not limited to the example illustrated. The inner group or layer may comprise more or fewer than three sub-cables. In one example, any of the bundled cables shown in FIGS. 3 and 4 may form the inner layer in the bundled cable of FIG. 5. It is to be appreciated that other structures for the bundled cable 160 may be apparent to those of skill in the art and are intended to be covered by this disclosure. In the illustrated embodiment, the inner sub-cables 162*a-c* may each have a unique individual lay scheme. For example, sub-cable 162*a* may have lay scheme "A," sub-cable 162*b* may have lay scheme "B" and sub-cable 162*c* may have lay scheme "C." Thus, each sub-cable 162*a-c* is adjacent sub-cables with different lay schemes. In one embodiment, the three sub-cables 162*a-c* may optionally be wrapped in a binder 168. Again referring to FIG. 5, in the illustrated example, the outer sub-cables 164, 166 may also be constructed to have lay schemes that are different than one another and different than the lay schemes of the inner sub-cables 162*a-c*. For example, the sub-cables 164 may have a lay scheme "D" and the sub-cables 166 may have a lay scheme "E." The sub-cables 164, 166 may be arranged in an alternating manner about the inner sub-cables 162*a-c*, such that each sub-cable in the bundled cable 160 is adjacent to sub-cables having lay schemes different than its own lay scheme. In one example, the sub-cables may be constructed such that a twist delta between the closing lay of any twisted pair in one lay scheme, for example, lay scheme "A," and any the closing lay of any twisted pair in another lay scheme, for example, any of lay schemes "B," "C," "D" and "E," is at least 0.020 inches. In another example, the twist delta may be in a range of approximately 0.020 inches to 0.040 inches.

As may be apparent from FIG. 5, in some circumstances, depending on the size of the sub-cables and the number of sub-cables making up the inner group or layer, it may be desirable to provide a sub-cable 170 in the outer layer that has another lay scheme, for example, lay scheme "F," so as to prevent two sub-cables with the same lay scheme from being located adjacent one another, which would occur if a sub-cable having either lay scheme "D" or "E" were placed in the location occupied by sub-cable 170 in FIG. 5.

Having thus described several aspects of embodiments of this invention, it is to be appreciated various alterations, modifications, and improvements will readily occur to those skilled in the art. For example, any of the cables described herein may include any number of twisted pairs and any of the jackets, insulations and separators shown herein may comprise any suitable material. In addition, any of the bundled cables described herein may include some shielded and some unshielded sub-cables, some four-pair sub-cables and some sub-cables having a different number of pairs. Furthermore, the sub-cables making up the bundled cables may include conductive or non-conductive cores or fillers having various profiles. In some examples, the multiple sub-cables making up the bundled cable may be helically twisted together and wrapped in an overall binder and/or conductive shield. The bundled cable may also optionally include a rip-cord to break the binder and release the individual cables from the bundle. The bundled cable may also be jacketed with an overall jacket. Such and other alterations, modifications, and improvements are intended to be part of this disclosure and are intended to be within the scope of the invention. Accordingly, the foregoing description and drawings are by way of example only and the scope of the invention should be determined from proper construction of the appended claims, and their equivalents.

What is claimed is:

1. A bundled cable comprising:

a first sub-cable comprising a first plurality of twisted pairs of insulated conductors each having a unique twist lay, the first sub-cable having a first lay scheme; and a second sub-cable comprising a second plurality of twisted pairs of insulated conductors each having a unique twist lay, the second sub-cable having a second lay scheme that is different than the first lay scheme; and wherein the first and second sub-cables are bundled together to form the bundled cable; and wherein a delta in twist lay between a closing lay of at least one twisted pair of the first plurality of twisted pairs of insulated conductors and a closing lay of at least one twisted pair of the second plurality of twisted pairs of insulated conductors is in a range of approximately 0.020 inches to approximately 0.040 inches.

2. The bundled cable as claimed in claim 1, further comprising a filler.

3. The bundled cable as claimed in claim 2, wherein the filler is located adjacent to the first and second sub-cables.

4. The bundled cable as claimed in claim 2, wherein the filler is conductive.

5. The bundled cable as claimed in claim 1, wherein each of the first and second sub-cables comprises a conductive shield respectively disposed about the first and second pluralities of twisted pairs.

6. The bundled cable as claimed in claim 1, further comprising an overall conductive shield at least partially surrounding the first and second sub-cables.

7. The bundled cable as claimed in claim 1, wherein each of the first and second sub-cables comprises a jacket respectively disposed about the first and second pluralities of twisted pairs.

8. The bundled cable as claimed in claim 1, further comprising a jacket enclosing the first and second sub-cables.

9. The bundled cable as claimed in claim 1, wherein the delta in closing lays between any one of twisted pair of the first plurality of twisted pairs of insulated conductors and any one twisted pair of the second plurality of twisted pairs of insulated conductors is in a range of approximately 0.020 inches to approximately 0.040 inches.

10. The bundled cable as claimed in claim 1, further comprising a third sub-cable comprising a third plurality of twisted pairs of insulated conductors each having a unique twist lay, the third sub-cable having a third lay scheme that is different than the first and second lay schemes;

wherein the delta in twist lay between the closing lay of any one twisted pair of the first plurality of twisted pairs of insulated conductors and a closing lay of any one twisted pair of the second and third pluralities of twisted pairs of insulated conductors is at least approximately 0.020 inches.

11. The bundled cable as claimed in claim 1, wherein the second lay scheme is different than the first lay scheme at any point along a longitudinal axis of the bundled cable.

12. The bundled cable as claimed in claim 1, further comprising a binder wrapped around the first and second sub-cables.

13. A method of reducing crosstalk between twisted pairs of adjacent sub-cables in a bundled cable, the method comprising:

providing a first sub-cable comprising a first plurality of twisted pairs of insulated conductors each having a unique twist lay, the first sub-cable having a first lay scheme;

providing a second sub-cable comprising a second plurality of twisted pairs of insulated conductors each having a unique twist lay, the second sub-cable having a second lay scheme that is different than the first lay scheme at any point along a longitudinal axis of the bundled cable; and bundling the first and second sub-cables together with an outer jacket that substantially encloses the first and second sub-cables along their lengths; and selecting the first lay scheme and the second lay scheme such that a delta in twist lay between a closing lay of at least one twisted pair of the first plurality of twisted pairs of insulated conductors and a closing lay of at least one twisted pair of the second plurality of twisted pairs of insulated conductors is in a range of approximately 0.020 to 0.040 inches.

14. The method as claimed in claim 13, wherein the step of bundling the first and second sub-cables together includes bundling a filler together with the first and second sub-cables.

15. The method as claimed in claim 13, wherein the step of bundling the first and second sub-cables together includes wrapping a binder around the first and second sub-cables.

16. The method as claimed in claim 13, further comprising steps of:

providing a first conductive shield disposed about the first plurality of twisted pairs; and providing a second a conductive shield disposed about the second plurality of twisted pairs.

17. The method as claimed in claim 13, further comprising a step of providing an overall conductive shield at least partially surrounding the first and second sub-cables.

18. The method as claimed in claim 13, further comprising steps of:

providing a first jacket disposed about the first plurality of twisted pairs; and providing a second jacket disposed about the second plurality of twisted pairs.

19. The method as claimed in claim 13, wherein selecting the first and second lay schemes includes making the selections such that the delta in closing lays between any one twisted pair in the first plurality of twisted pairs of insulated conductors and any one twisted pair in the second plurality of twisted pairs of insulated conductors is in a range of approximately 0.020 inches to approximately 0.040 inches.

20. The method as claimed in claim 13, further comprising steps of:

bundling together with the first and second sub-cables a third sub-cable comprising a third plurality of twisted pairs of insulated conductors each having a unique twist lay, the third sub-cable having a third lay scheme that is different than the first and second lay schemes; and selecting the third lay scheme such that the delta in twist lay between the closing lay of any one twisted pair of the first plurality of twisted pairs of insulated conductors and a closing lay of any one twisted pair of the second and third pluralities of twisted pairs of insulated conductors is at least approximately 0.020 inches.

* * * * *